US005106661A

United States Patent [19]

Pitts, Sr.

[11] Patent Number: 5,106,661

[45] Date of Patent: Apr. 21, 1992

[54] COMPRESSIBLE CHRISTMAS TREE

[76] Inventor: Clifford R. Pitts, Sr., 2 Cardinal Ct., Woodridge, Ill. 60517-1734

[21] Appl. No.: 617,553

[22] Filed: Nov. 26, 1990

[51] Int. Cl.[5] ..... A47G 33/06

[52] U.S. Cl. ..... 428/20; 211/196; 211/205

[58] Field of Search ..... 428/18, 19, 20; 211/196, 205

[56] References Cited

U.S. PATENT DOCUMENTS

| | | | |
|---|---|---|---|
| 1,600,687 | 9/1926 | Mantz | 428/18 X |
| 2,732,646 | 1/1956 | James | 428/20 |
| 2,841,901 | 7/1958 | Maple | 428/20 X |
| 2,909,356 | 10/1959 | Salick | 428/20 X |
| 3,176,123 | 3/1965 | Blake | 428/20 X |
| 3,677,867 | 3/1971 | Westlund | 428/20 X |
| 3,813,277 | 5/1974 | Kleiman et al. | 428/20 X |
| 3,967,019 | 6/1976 | Magee | 428/18 X |
| 4,020,201 | 4/1977 | Miller | 428/20 X |
| 4,054,696 | 10/1977 | Crownover | 428/20 X |
| 4,130,678 | 12/1978 | Higgins | 428/20 X |
| 4,172,913 | 10/1979 | Ballah et al. | 428/20 X |
| 4,331,720 | 5/1982 | Vin Dick et al. | 428/20 X |
| 4,399,172 | 8/1983 | DeCosmo | 428/20 X |
| 4,451,510 | 5/1984 | Boisvert et al. | 428/20 X |
| 4,748,058 | 5/1988 | Craig, Jr. | 428/18 X |
| 4,847,123 | 7/1989 | Armstead et al. | 428/20 X |

FOREIGN PATENT DOCUMENTS 168799 2/1957 Sweden .

*Primary Examiner*—Henry F. Epstein

[57] ABSTRACT

A compressible artificial tree includes a vertically extending trunk mounted on a stand or base. Branch units formed of branches radially extending from rings are slidably mounted on the trunk and are held in spaced relation by springs extending therebetween. The branch units are vertically compressible toward one another onto a lower portion of the trunk. Once held in the compressed state by a storage pin, the upper portion of the trunk and the tree top are removed to enable the compressed artificial tree to be stored.

12 Claims, 2 Drawing Sheets

COMPRESSIBLE CHRISTMAS TREE

BACKGROUND OF THE INVENTION

1. Field of the Invention

The ion relates generally to an artificial tree or plant and, more particularly, to an artificial tree which is compressible for storage.

2. Description of the Related Art

As part of the celebration of the Christmas season, it has become traditional to bring a pine tree into one's home and to decorate the tree with ornaments, lights, garland, tinsel, and other manner of symbolic and decorative items. The more tradition-bound among us obtain a cut, live pine tree and bring this live tree into the home for decorating and display over the Christmas season. Live trees, however, have become quite expensive and are recognized as a waste of environmental resources. In addition, such trees are messy, leaving sap and needles behind after removal, and require watering to prevent drying out and becoming a fire hazard. Each time a live tree is obtained, it must be decorated and at the end of the Christmas season the decorations must be removed. Since the needles have dried and become quite sharp by this time, removal of the decorations can be a painful process.

To overcome the disadvantages in the use of a live tree, a great variety of artificial trees, particularly for use during the Christmas season, are available. For the most part, these artificial trees are to be assembled for use and then disassembled after use. The assembly and disassembly process can be difficult and also time consuming. Even when disassembled, the known artificial trees occupy considerable space. Also, many of the known artificial trees require removal of the decorations prior to disassembly, thus adding decorating and un-decorating time to the time already required for assembly and disassembly. It can thereby become an overwhelming task to put up, decorate, and take down a Christmas tree for an individual who lacks the time or physical ability.

An artificial mechanical tree is disclosed in U.S. Pat. No. 4,054,696, which includes a pole member and a plurality of vertical, accordion-type limb sections. Each limb section includes a generally tubular member having upper and lower sleeves connected by a tubular section of compressible and expandable accordion-type material of rubber or plastic. The artificial tree limbs are attached to the accordion-type section by adhesive or alternately by a wire as a reinforcement. The tree limb sections are removed from the center pole for storage of the disassembled tree.

U.S. Pat. No. 4,748,058 discloses an artificial tree formed of a collapsible three-piece pole with a number of limb sections and interconnecting garlands. Each limb section has a central ring portion with a number of limb members extending radially outward in the central ring. The garlands interconnect the limb portions so that the ring portions are lifted from the top from the stacked position and slide along the pole, the garlands being tensioned to lift the next adjacent section until the tree is fully erect.

A pop-up artificial Christmas tree is disclosed in U.S. Pat. No. 4,847,123 in which an elongated trunk has a plurality of stationary sleeves attached thereto and a guide sleeve slidable to proximate and remote from an adjacent stationary sleeve. The tree is popped up much like the opening of an umbrella.

SUMMARY OF THE INVENTION

An objection of the present invention is to enable a Christmas tree to be quickly and easily set up and taken down.

A further object of the invention is to provide a very compact Christmas tree when in a compressed state.

Another object of the invention is permit a Christmas tree to remain decorated when being taken down so that redecorating need not be done each time the tree is set up. The decorations which may remain on the tree include ornaments, garland, tinsel, and even lights.

Yet another object of the invention is to permit collapsing and storage of a Christmas tree without removal from the stand.

These and other objects and advantages of the invention are achieved by a compressible Christmas tree formed of a vertical trunk mounted in a stand, on the trunk are slidably mounted branch units held in spaced relation to one another by biasing means. The biasing means of a preferred embodiment are springs disposed between adjacent branch units The springs are compressible to enable the branch units to be brought closer together for vertical compression of the tree into a compact state. The springs also bias the branch units away from each other so that the tree expands from its compressed state to an extended state for display. The springs suspend the branch units from the top-most branch unit when fully erected.

More specifically, the present tree includes a ground engaging stand for holding the trunk in a generally vertical position. Any of a variety of known stands may be used so long as the stand supports the tree in a stable position. Many different tree stands are available, and it is contemplated that any of these may be used. Alternately, a widening of the trunk may be used in place of a stand, or some other shaping of the trunk may facilitate vertical placement of the trunk where no stand is required. For example, a tapered trunk end may fit into an opening in the floor to mount the tree in, for instance, a commercial display. A vertically compact stand having a height of no more than 6 inches is preferred so that the present tree has the shortest possible vertical extent when in the compressed position.

The trunk of the present compressible tree is an elongated vertical structure preferably of constant cross section. The trunk is vertically collapsible so that it is variable in height between a shorter, collapsed position and a longer, extended position. Various means for collapsing and extending the trunk are contemplated for use in the present position. In a preferred embodiment, the trunk is of a multi-part design having a plurality of trunk elements connectable to one another to form the extended trunk. A threaded connection ma be provided between the various trunk elements. Although other types of connectors, such as bayonet connections, locking sleeves, etc. are also possible.

Although at least two trunk elements are required to effectively compress the tree of the present invention, it is also possible to provide a greater number of trunk elements. The lowermost trunk element is preferably of a length corresponding to the compressed height of the overall tree. In one embodiment, the lowermost trunk section is approximately 18 inches in length. The outer surface of the trunk can be provided with various decorative or design coverings and should be smooth to improve the sliding movement of the branch units along the trunk.

At the top end of the trunk is mounted a tree top to provide a finished look to the present tree. The tree top preferably mounts by a center spike fitting into a hole in the top end of the trunk. It is contemplated to use different heights of tree tops so that the overall height of the tree can be varied without changing the other elements of the tree.

Disposed along the tree trunk between the tree top and the base or stand are a plurality of branch units defining the body of the tree when in the extended position. The branch units taper from larger to smaller on the trunk to provide a generally conical overall shape, although an irregular shape may be preferred for a more natural looking tree. The branch units, which are centered on the trunk, are slidably mounted for movement along the trunk.

Each of the branch units is formed by a ring having a center opening through which the trunk extends, and a number of branches attached to the ring and extending generally radially outward. The ring of a preferred embodiment has an outer sleeve of a strong and durable material such as steel to which the branches are attached, for example, by welding. Within the outer sleeve is mounted an inner sleeve or bushing of a plastic or like material to facilitate sliding of the rings along the trunk. In one embodiment, the bushing is formed of sections of PVC tubing mounted within the steel outer sleeve.

The branches mounted on the rings are preferably of a steel wire provided with artificial pine needles which branch out into multiple branch ends to provide a full look to the artificial tree. Lower branch units are provided with a greater number of branches than upper branch units to fill in the greater tree diameter at the lower parts of the tree. For example, lower branch rings may be provided with six branches, while five branches are mounted on middle rings and four branches are provided on the uppermost rings. It is also contemplated to arrange the branches extending from different levels on the individual rings rather than from a single level. Accordingly, some branches can extend from the top edge of the ring and some from the bottom edge of a ring for a fuller look to the tree. The use of a flexible material for the branches enables the branches to be bent or formed as desired so that a slightly upward cant may be imparted on each branch.

The lowermost of the branch units is not attached to a lower portion of the trunk, but instead is suspended by the tension in the springs and are free to slide along the trunk.

A means for selectively attaching an uppermost branch unit to a top end of the trunk is also provided so that the branch units are retained in their extended position. This attaching means, which can include a pin extending through the trunk, is selectively removable to permit the branch units to be slid downwardly along the trunk and toward a compressed position. A storage pin, or even the same pin used to hold the branch units in the extended position, is inserted through the trunk to hold the top branch unit in the lower, compressed position on the trunk.

As mentioned previously, a biasing means, preferably in the form of springs, extends between each of the adjacent rings of the branch units. The springs permit the branch units to be compressed toward one another, yet bias the individual branch units away from one another so that the branch units are pushed toward the extended position. Furthermore, the springs suspend the branches from the attached top-most branch unit when the tree is in the extended position. When in the extended position, the springs also retain the relative positions of the branch units along the trunk so that the branch units are generally evenly spaced from one another.

Various springs may be used. In one embodiment, springs of a constant diameter are used between some of the branch rings while others of the springs are of varying diameters. The springs are preferably attached to the rings by a snug fit and the rings are shaped to receive the springs, including by the provision of notches on the branch rings and/or by the provision of chamfers on the end surfaces of the branch rings. In one embodiment, the springs are formed of 90 gauge wire.

To complement the appearance of the compressible tree and hide the springs, annularly formed elements of the same material as the branches loosely encircle the springs. These elements compress along with the springs during compression of the tree.

The tree as described above is compressible into a compact storage box of a size and shape for easy storage In an embodiment which forms a seven foot Christmas tree when in a fully extended position, the tree is compressible into a storage box measuring 3 feet by 3 feet square and 18 inches high. The overall height of the tree when in the extended position is determined by the height of the tree top used and the length of the trunk sections when assembled. When a shorter tree is desired, a shorter trunk extension and/or a shorter tree top is used. The opposite is true for a taller tree.

In addition to the structural features of the present tree, a method for assembling and disassembling a compressible tree is also provided by the present invention. The method for assembly includes, generally, removing from a storage box the treetop, the top portions of the trunk, and the compressed tree mounted on the base. The top portion of the trunk is then attached to the compressed tree, the treetop is added to the top of the assembled trunk, and the pin maintaining the tree in the compressed position is unlatched to permit the springs to expand and push the branch units up the trunk. The pin is inserted through the trunk to retain the top unit in the extended position. It may be necessary to push the top branch unit upward into position if the springs have been compressed for some time.

In the method for disassembly, the branches of the decorated tree are pushed down the trunk, and the latch screw or pin is put into place to hold the top branch in its lowermost position. The treetop is then removed from the top of the trunk portion, the top of the trunk portion is removed from the lower trunk portion, and the compressed tree is placed into the box along with the trunk top portion and the treetop.

Although it is contemplated that the decorations for the tree may remain on the tree during assembly and disassembly, it is, of course, also possible that the tree may be decorated each time it has been assembled.

Not only does the present tree provide a time saving and easy to use Christmas tree for the home, but the present tree finds particular applicability in commercial uses. Those who prepare commercial Christmas displays will appreciate the ease with which the present tree is erected, the compact size when compressed, and the durable construction. The ability to leave the tree decorated during storage provides an added advantage.

Further advantages and improvements of the invention will become apparent during review of the following detailed description along with the accompanying drawings.

DETAILED DESCRIPTION OF THE PREFERRED EMBODIMENTS

Figure 1:
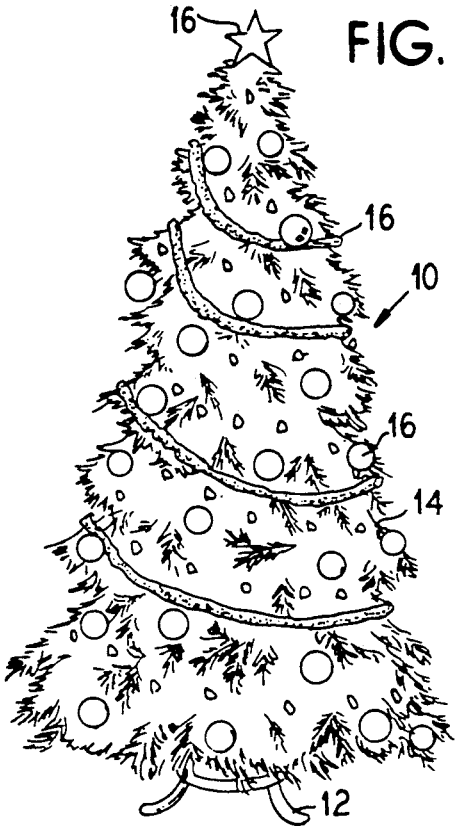
FIG. 1 is a perspective view of the compressible Christmas tree of the present invention in a fully and extended decorated position.

In FIG. 1, a compressible artificial pine tree 10 is shown including a base or stand 12, a plurality of branches 14 and decorations 16. The branches 14 are longer toward the base of the tree and are progressively shorter near the top of the tree to give the artificial tree 10 a generally conical overall shape. The decorations 16, which may include ornaments, lights, garland, tinsel and other items of a decorative or symbolic nature are attached to the artificial tree according to personal taste. Should one desire to leave the decorations on the tree when the tree is compressed, a more permanent means of attaching the decorations than the usual ornament hooks would be used.

Figure 2:
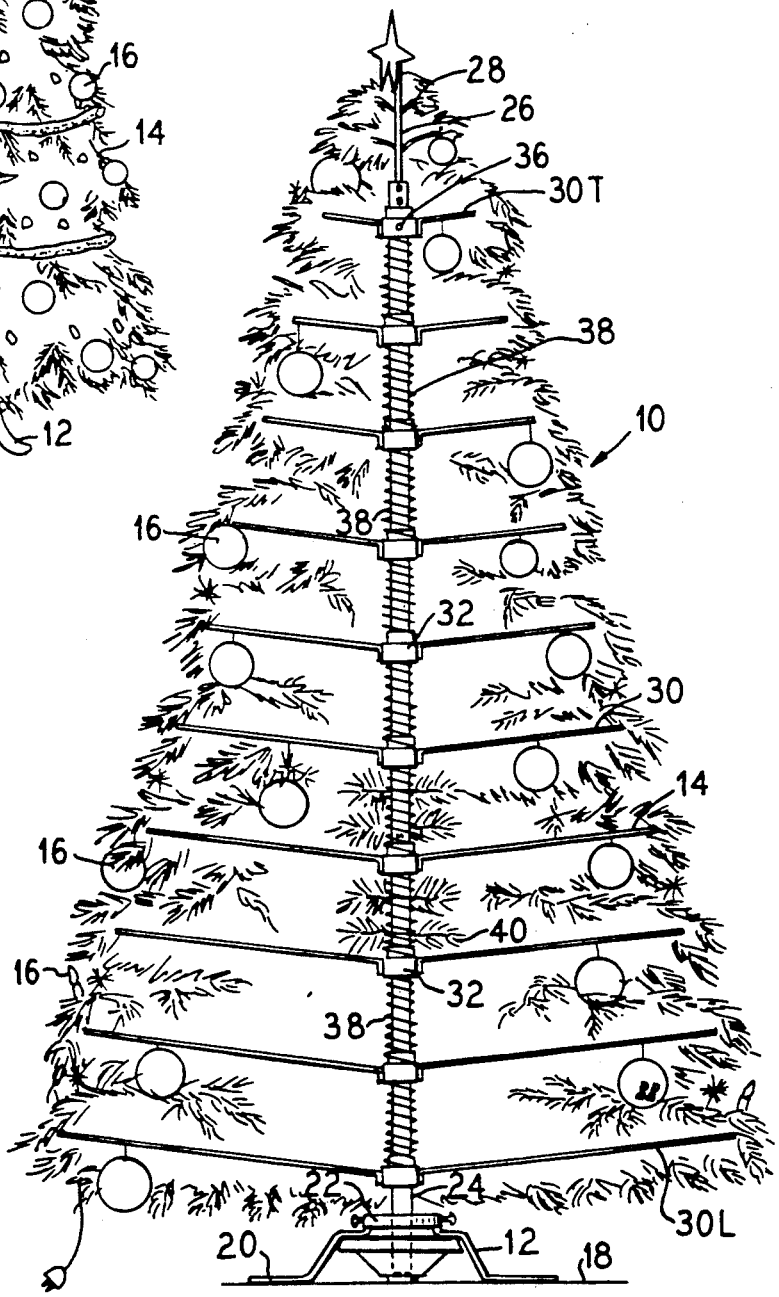
FIG. 2 is a vertical cross section of the Christmas tree of FIG. 1.

Referring now to FIG. 2, the artificial tree 10 stands on a horizontal surface 18, such as a floor or table top, and is maintained in a generally vertical position by the stand or base 12. The illustrated stand 12 is a type typical for use with live trees and includes a number of legs 20 extending outward from a center support 22. It is, of course, possible to use a variety of other stands or bases for the present tree. The stand should be no more than six inches in height so that the tree may be compressed to the shortest possible height.

Mounted in the stand 12 is a trunk 24 in the form of an elongated pole of generally constant diameter. At the opposite end of the trunk 24 is mounted a tree top 26. The tree top 26 is a generally conical arrangement of artificial conifer branch material simulating the top of a pine tree. The tree top 26 includes a center post 28, the lower end of which fits into an axial bore formed in the top end of the trunk 24.

Disposed at generally regular intervals along the trunk 24 are branch units 30 which include the branches 14 supported on rings 32. The lower most branch unit 30L is free to slide along the trunk 24, while the top most branch unit 30T is connected adjacent the top end of the trunk 24 by a connecting screw 36 which is threaded in the branch ring until it bears against the trunk 24.

The branch units 30 between the lower most branch unit 30L and the top most branch unit 30T are held at generally regularly spaced intervals by springs 38, with each of the branch units being suspended from the top most branch unit via the springs.

The branches 14 are covered by artificial conifer branch material and, although illustrated as straight, may be irregularly formed and include sub-branches to give the tree a natural appearance. To further enhance the natural appearance of the tree, branch circles 40 are mounted encircling the trunk 24 between the rings 32 to cover the springs 38. The branch circles 40 are of the same material as the branches 14.

Figure 3:
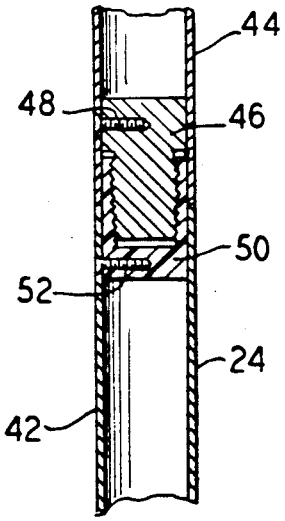
FIG. 3 is vertical cross section through a connection linking two trunk portions of the present compressible tree.

In FIG. 3 is shown a cross section of the trunk 24 which is in the form of a hollow tube or pipe. To facilitate compressing of the present artificial tree into a compact shape, the trunk 24 is divided into at least two trunk segments which are removable from each other. In this regard, a lower segment of the trunk 42 is connected to an upper segment of the trunk 44 by a threaded connection. A threaded male member 46 is held in the inside of the upper segment 44 adjacent the open end thereof by a screw 48. A similarly threaded female member 50 is held within the lower segment 42 adjacent the open end thereof by a screw 52. For added stability, the male member 46T is recessed in the upper segment 44 so that the threaded female member 50 extends somewhat into the upper segment 44. A reinforced threaded connection between the two trunk segments 42 and 44 is thereby provided. At least one such connection is provided in the trunk 24 so that the trunk is in two segments. It is also possible that several such connection are provided so that three or more trunk segments are used to form the trunk 24.

Figure 4:
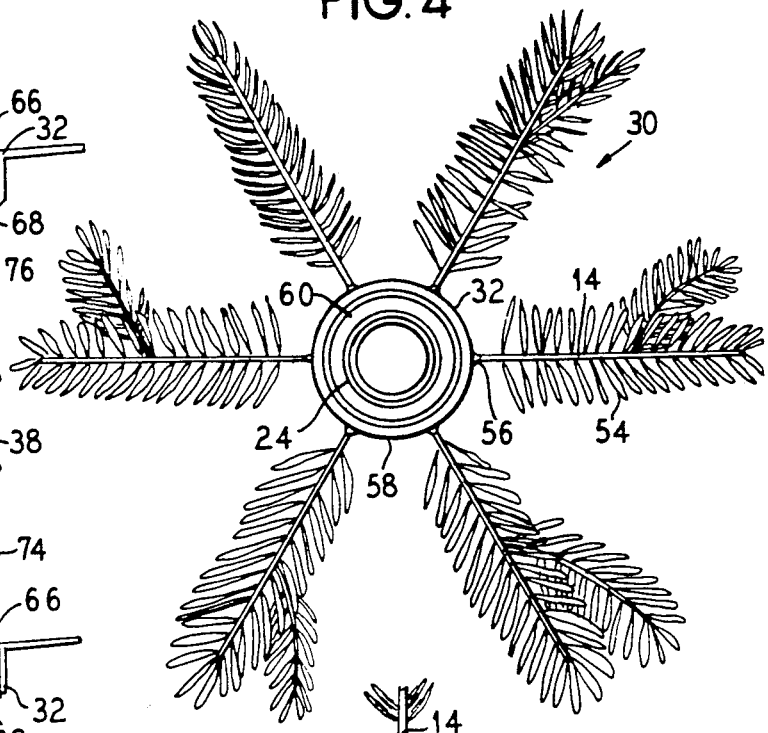
FIG. 4 is a plan view of an individual branch unit.

In FIG. 4 is shown one of the branch units 30 having the branch ring 32 to which is mounted six of the branches 14. Each of the branches 14 is illustrated as a straight branch, although it is also contemplated to provide various irregular and branching sub-branches to lend a full appearance to the tree. The branches include needles 54 to simulate a conifer or fir tree branch. Each of the branches 14 is held to the ring 32 by a weld 56.

The ring 32 contains an outer ring 58 of steel and an inner ring or bushing 60. The bushing 60 is of a plastic or other material to facilitate sliding of the rings 32 along the trunk. Within the bushing 60 can be seen the tube of the trunk 24.

Figure 5:
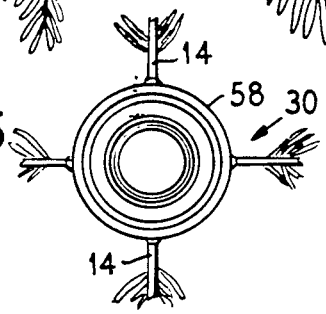
FIG. 5 is a fragmentary view of a second embodiment of a branch unit.

FIG. 5 depicts an alternate possibility for the construction of the branch units 30, wherein four branches 14 are mounted on the ring 58. The branch unit 30 is located closer to the top of the artificial tree 10 relative to the six branch unit shown in FIG. 4. Of course, branch units having five branches and branch units having greater than six or fewer than four branches may also be provided for the present tree.

Figure 6:
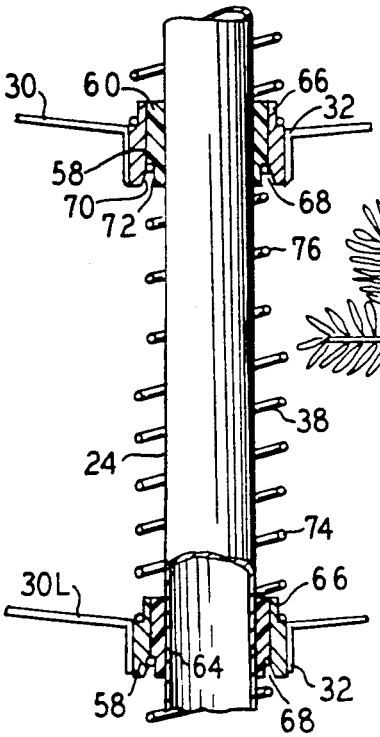
FIG. 6 is an elevational fragmentary view, partially in cross section, of the trunk with two branch units held in spaced relation by a spring in an extended position.

In FIG. 6 is shown an enlarged view of a portion of the trunk 24 having the lower most branch unit 30L freely slidable on the trunk when the tree is fully extended.

The upper branch unit 30 shown in FIG. 6 supports via the tension in the spring 38 the lower branch unit 30L. The spring 38 is mounted on the outer ring 58 of the lower branch unit 30L at a notch 66 cut therein. A lower end of the spring 38 is friction fit about the notch 66. A channel 68 in the underside of the ring 32 receives the upper end of the spring 38. The channel 68 is formed by a chamfer 70 at an inside surface of the outer ring 58 and a notch 72 in the bushing 60. Each of the branch units 30, with the exception of the lowermost branch unit 30L and the top-most branch unit 30T, has a spring 38 connected about a notch 66 at the top end thereof and in a channel 68 at the bottom end thereof.

The spring 38 may be of a constant diameter or may, alternately, be of different diameters along its length. In the embodiment illustrated in FIG. 6, the spring 38 includes a lower portion 74 of a first, larger diameter and an upper portion 76 of a second, smaller diameter. This change in diameter facilitates insertion of the spring about the notch 66 and into the channel 68. It may also permit a greater compression of the spring in an axial direction of the trunk 24. Preferably, the spring 38 between a first pair of the branch units is of a relatively large constant diameter, and are mounted about the outside of the rings in the notches on both of the rings. The spring between the next successive pair of the branch units is of a smaller constant diameter, and thereby fits into the channels 68 of the branch rings. Thus, the branch rings are mounted with the channels 68 facing up and facing down on every other ring on the trunk. The top two spring are to the dual diameter type shown in FIGS. 6 and 7, and so the branch rings connected to these springs are mounted with the channels 68 facing down.

It is contemplated that the connection of the spring to each of the rings in the branch units ma be by an external notch, such as the notch 66, on both the top and bottom surfaces of the rings, or alternately, by an internal channel, such as the channel 68 on both the top and bottom surfaces of each ring.

Figure 7:
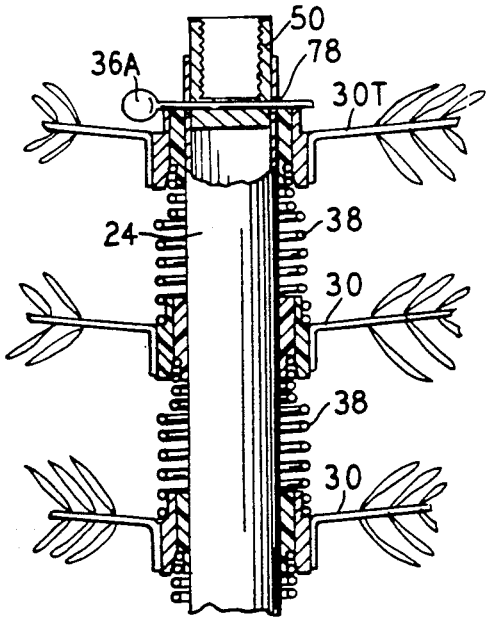
FIG. 7 is a fragmentary elevational view, partially in cross section, of the trunk with a plurality of branch units spaced by the springs in a compressed condition.

The top branch unit 30T is held in place at the top end of the trunk 24 by the connecting screw 36 extending through an opening in the ring of the top branch unit 30T and against the trunk 24. To vertically compress the tree 10, the connecting screw 36 is released and the branch units are pressed vertically downward to slide along the trunk 24 until the top branch unit 30T is below the upper end of the lower portion of the trunk. The screw 36 is then rotated to bear against the trunk 24 so that the upward pressure of the springs 38 cannot extend the branch units upwardly along the trunk. Alternately, a pin 36A is provided in which the pin 36 is inserted through a bore 78 in the lower portion of the trunk, as shown in FIG. 7. The bore 78 is preferably slightly below the threaded connection at the top of the lower most trunk portion. In this position, the lower most branch unit 30L rests against the stand.

Figure 8:
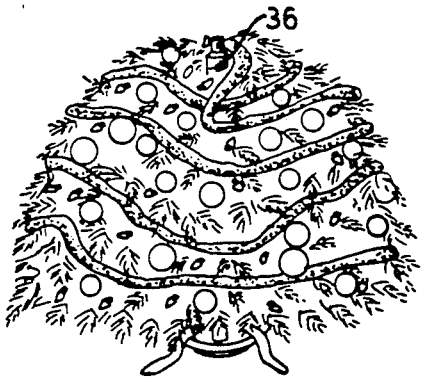
FIG. 8 is a perspective view of the compressible Christmas tree in a compressed condition, according to the principles of the present invention.

The upper portion, or portions, of the trunk are then removed, along with the tree top 26, so that the tree has an overall appearance in a compressed state as shown in FIG. 8. In one embodiment, the compressed tree as shown in FIG. 8 is 18 inches high yet expands to form a tree 7 feet tall when fully assembled.

The branches 14 mounted on the rings 32 are shown in FIGS. 6 and 7 extending from the top edges of the rings 32. To provide a more natural and irregular arrangement of branches, it is contemplated to mount some of the branches 14 on each ring 32 extending from a lower edge of the rings or at some intermediate point.

The springs in their compressed state as shown in FIG. 7 retain some spacing between the spring coils. Depending upon the spring construction and tension, the spring coils may lie against one another when in a fully compressed state.

Thus, there has been shown and described a compressible artificial tree achieving the objects of the present invention.

Although other modifications and changes may be suggested by those skilled in the art, it is the intention of the inventor to embody within the patent warranted hereon all changes and modification as reasonably and properly come within the scope of his contribution to the art.

I claim:

1. A compressible artificial tree, comprising:

a trunk member having a base at a lower end, said trunk member being an elongated shaft adapted for generally vertical orientation when said base is disposed on a generally horizontal surface;

a plurality of branch segments disposed at intervals along said trunk member, each of said plurality of branch segments including:

a ring encircling said trunk member;

at least one branch extending in a direction having a radially outward component from said ring of each of said plurality of branch segments;

coil springs encircling said trunk member and being slidable therealong, said coils springs extending between neighboring ones of said plurality of branch segments to bias said plurality of branch segments away from one another along said trunk member, said springs being compressible to move said plurality of branch segments toward one another and thereby reduce an overall extent of said plurality of branch segments along said trunk member.

2. A compressible artificial tree as claimed in claim 1, wherein each of said plurality of branch segments has a plurality of branches extending in a direction having a radial component from said ring.

3. A compressible artificial tree as claimed in claim 1, further comprising:

a tree top removable connected to a top end of said trunk member.

4. A compressible artificial tree as claimed in claim 1, wherein said branches on said branch segments are of generally decreasing lengths relative to branches on next lower ones of said branch segments disposed on said trunk.

5. A compressible artificial tree, comprising:

a segmented elongated center post having a lower ground engaging end and an upper end;

a plurality of branch parts mounted on said center post, ones of said branch parts being selectively movable along said center post, consecutive ones of said branch parts along said center post being of generally increasing radius from said upper end to said lower end;

spring means mounted external of said center post for biasing said plurality of branch parts away from each other to positions on said center post relatively spaced from one another, said spring means for biasing being compressible to move said plurality of branch parts toward one another along said center post;

a tree top at said upper end of said center post.

6. A compressible artificial tree as claimed in claim 5, wherein said center post includes segments threadably affixed to one another.

7. A compressible artificial tree as claimed in claim 5, wherein said spring means for biasing comprises a plurality of coil springs extending between neighboring ones of said branch parts and encircling said center post and being slidable along said center post.

8. A compressible artificial tree as claimed in claim 7, wherein each of said coil springs is of a constant diameter.

9. A compressible artificial tree as claimed in claim 7, wherein ones of said coil springs include portions of at least two different diameters.

10. A compressible artificial tree as claimed in claim 7, wherein said branch parts each comprise a plurality of branches extending in a direction having at least a radial component from a center of said part.

11. A compressible artificial tree as claimed in claim 10, wherein each of said branch parts comprise:

a ring encircling said center post in sliding engagement, said plurality of branches being affixed to said ring.

12. An artificial Christmas tree, comprising:

a base;

a plurality of center post sections connected end-to-end by threaded connections to form a center post, all of said center post sections being of substantially the same outside diameter, a lower one of said center post sections being mounted in said base so that said center post extends upwardly in a generally vertical direction from said base, said center post sections being separable from one another;

a tree top removable mounted on an end of said center post opposite said base;

a plurality of rings slidably mounted encircling said center post, a lower one and an upper one of said rings being removably connected to said center post adjacent opposite ends of said center post, all of said rings having substantially the same inner diameter;

a plurality of coil springs slidably mounted encircling said center post, each of said coil springs being connected to and extending between adjacent ones of said rings, said coil springs exerting biasing forces on said rings to maintain middle ones of said rings in spaced positions relative to one another when said lower one and said upper one of said rings are connected adjacent opposite ends of said center post, said coil springs accommodating movement of said rings toward one another so that said rings can be compressed onto a single center post segment; and a plurality of artificial tree branches mounted on each of said rings and extending outwardly in an arrangement to form a tree-like configuration when said lower one and said upper one of said rings are connected adjacent opposite ends of said center post.

* * * * *